United States Patent [19]

Lokken

[11] 4,121,878

[45] Oct. 24, 1978

[54] CABINET DRAWER RESTRAINER

[75] Inventor: Gene B. Lokken, Mishicot, Wis.

[73] Assignee: American Hospital Supply Corporation, Evanston, Ill.

[21] Appl. No.: 789,112

[22] Filed: Apr. 20, 1977

[51] Int. Cl.[2] ..... A47B 88/16

[52] U.S. Cl. ..... 312/341 R; 312/348; 312/350

[58] Field of Search ..... 312/319, 330, 333, 341, 312/348, 350; 308/3.6, 3.8

[56] References Cited

U.S. PATENT DOCUMENTS

| | | | |
|---|---|---|---|
| 3,328,106 | 6/1967 | Mullin | 312/341 R |
| 3,386,784 | 6/1968 | Oppenhuizen et al. | 312/341 |
| 3,658,394 | 4/1972 | Gutner | 312/348 |
| 3,995,927 | 12/1976 | Stein | 312/333 |

*Primary Examiner*—Casmir A. Nunberg
*Attorney, Agent, or Firm*—Tilton, Fallon, Lungmus & Chestnut

[57] ABSTRACT

A resilient restraining member for use with a cabinet having a drawer. The cabinet includes a rail integral with the drawer, a run secured to the cabinet and transport means secured to the drawer. The resilient restraining member has a first spring portion at one end adapted to be attached to the run and a second spring portion at the other end adapted to normally extend into the run. The transport means is disposed to travel along the run and to urge the second spring portion out of its path of travel as the drawer is moved toward a closed position. The second spring portion thereafter returns to its normal position extending into the run to cooperate with the transport means to releasably retain the drawer in the closed position. The transport means again is disposed to travel along the run and to urge the second spring portion out of its path of travel as the drawer is later moved toward an open position. The resilient restraining member prevents unintentional movement of the drawer from the closed position to the open position. The cabinet or its environment can therefore be moved without consequent movement of the closed drawer. With these features of construction, the resilient restraining member provides a cabinet drawer restrainer useful with any cabinet having a drawer.

13 Claims, 7 Drawing Figures

FIG. 1
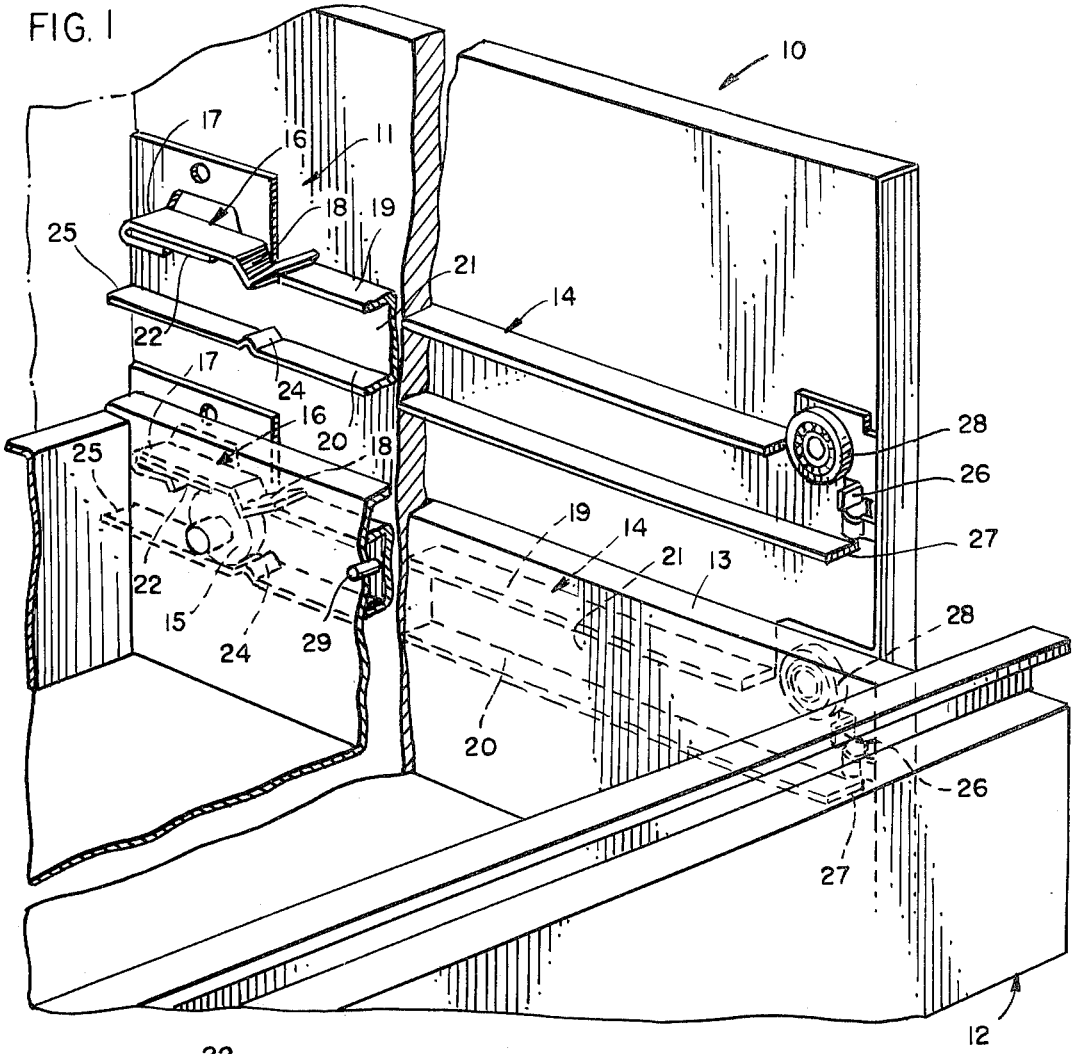
FIG. 2
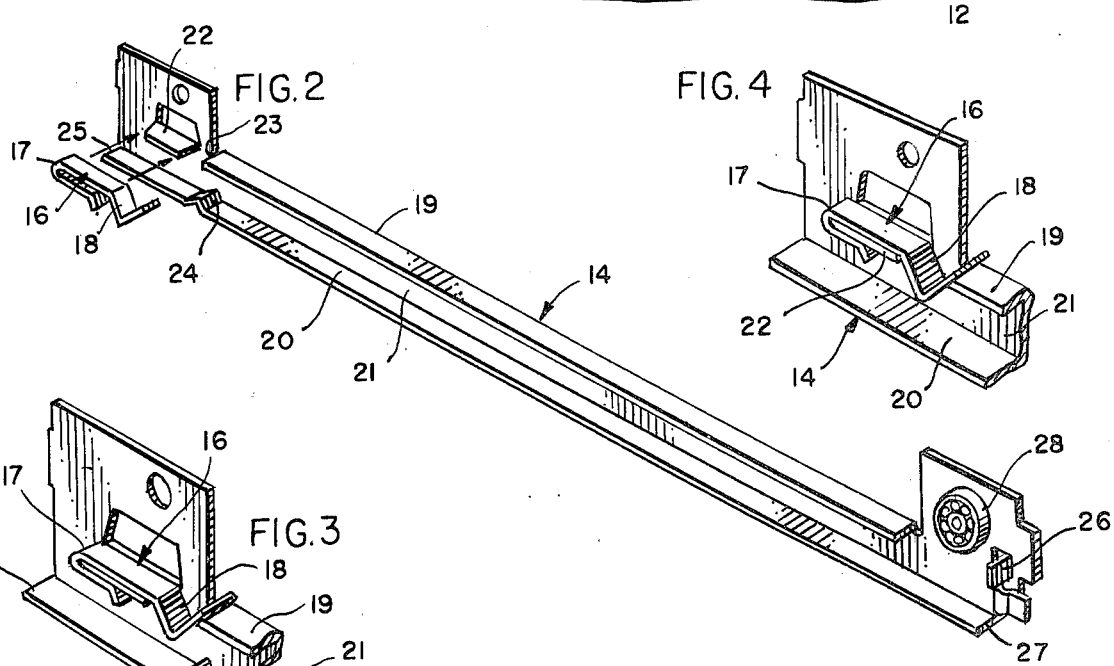
FIG. 4
FIG. 3
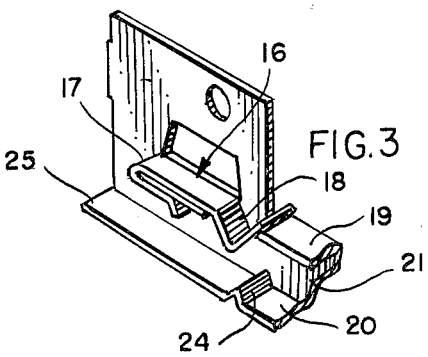

CABINET DRAWER RESTRAINER

BACKGROUND

This invention relates to a cabinet drawer restrainer, and more particularly, to a resilient restraining member for preventing unintentional movement of a cabinet drawer from a closed position to an open position.

Cabinets having drawers have long been known in varieties too numerous to mention. It has been common, however, for many of such cabinets to have a construction which includes a rail or glide secured to the drawer and a run secured to the cabinet. A roller or rollers are also sometimes provided to facilitate movement of the drawer from a closed position to an open position and back again to a closed position. It has been found, however, that unintentional movement of the drawer from the closed position to the open position is sometimes caused by movement of the cabinet or its environment. While this is less of a problem with permanent cabinets, it presents an extremely vexing problem relative to mobile cabinets or cabinets affixed in mobile transporting or carrying means such as ships.

The problems encountered have lead to a search for a cabinet drawer restrainer capable of preventing unintentional movement of the drawer from a closed position to an open position. It has been known, for instance, to provide a reverse indent in a run attached to a cabinet to serve as a slight obstruction to a roller attached to a drawer. The resistance provided by the indent has been found to be of help in maintaining the drawer in a closed position while at the same time making it easy for a person wishing to gain access to the cabinet to later move the drawer to an open position. It has been learned, however, that the reverse indent is not always sufficient to maintain the drawer in a closed position during movement of the cabinet or its environment. With the problems of the prior art in mind, I sought to develop a cabinet drawer restrainer which is capable of accomplishing the outlined objectives.

While the prior art, as exemplified by U.S. Pat. Nos. 3,194,623, 3,658,394, and 365,398 has dealt with the problems associated with providing a cabinet drawer restrainer with varying degrees of success, the present invention represents an improvement over all such prior art constructions.

SUMMARY

The present invention is directed to a resilient restraining member for use with a cabinet having a drawer. The cabinet includes a rail integral with the drawer, a run secured to the cabinet and a transport means secured to the drawer. The resilient restraining member has a first portion at one end adapted to be attached to the run and a second spring portion at the other end adapted to normally extend into the run. The transport means consists of a rider, either in the form of a roller or a glide, and is disposed to travel along the run and to urge the second spring portion out of its path of travel as the drawer is moved toward a closed position. The second spring portion thereafter returns to its normal position extending into the run to cooperate with the transport means to releasably retain the drawer in the closed position. The transport means again is disposed to travel along the run and to urge the spring detent portion out of its path of travel as the drawer is later moved toward an open position. The resilient restraining member prevents unintentional movement of the drawer from the closed position to the open position. The cabinet or its environment can therefore be moved without consequent movement of the closed drawer. With these features of construction, the resilient restraining member provides a cabinet drawer restrainer particularly useful with mobile cabinets and cabinets affixed in mobile transporting or carrying means such as ships.

In a preferred embodiment of the invention, the transport means is a roller with the first spring portion being a clip and the second spring portion being a detent. The run is a generally C-shaped channel having spaced top and bottom members joined by a side member. The top member is interrupted along its length to define a clip receiving tab and a detent receiving opening with the bottom member having a reverse indent extending into the run in the path of travel of the roller. The reverse indent in the bottom member is generally V-shaped extending upwardly in alignment with the detent receiving opening in the top member. The spring detent portion is also generally V-shaped normally extending through the detent receiving opening into the run with the spring clip portion having a barb to bitingly engage the clip receiving tab to retain the resilient restraining member in position. The run also includes a stop in the form of a projection extending into the run in the path of travel of a pin or other suitable protrusion attached to the drawer to limit movement of the drawer between the closed position and the open position.

The present invention therefore retains the advantages inherent in cabinets having drawers while at the same time providing an improved construction that eliminates the problems heretofore associated with cabinet drawer restrainers. It is therefore an object of the present invention to provide a cabinet drawer restrainer capable of preventing unintentional movement of a drawer from a closed position to an open position that might otherwise be caused by movement of a cabinet or its environment. The provision of the cabinet drawer restrainer and the realization of the advantages to be derived therefrom constitute additional important objects of the present invention with still other objects being appreciated from the details of construction and operation set forth in the accompanying specification, claims and drawings.

DRAWINGS

The invention is described in conjunction with the accompanying drawings, in which:

FIG. 1 is a partial perspective view of a cabinet having a drawer utilizing the cabinet drawer restrainer in accordance with the present invention;

FIG. 2 is a perspective view of a resilient restraining member being brought into engagement with a run;

FIG. 3 is a partial perspective view of a resilient restraining member and run assembly with a reverse indent extending into the run;

FIG. 4 is a partial perspective view of a resilient restraining member and run assembly without a reverse indent extending into the run;

DESCRIPTION

Figure 5:
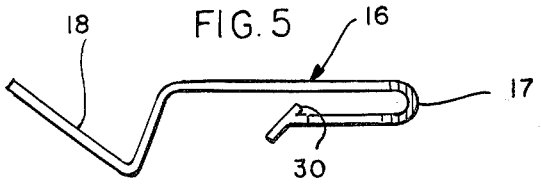
FIG. 5 is a side elevational view of a resilient restraining member.
Figure 6:
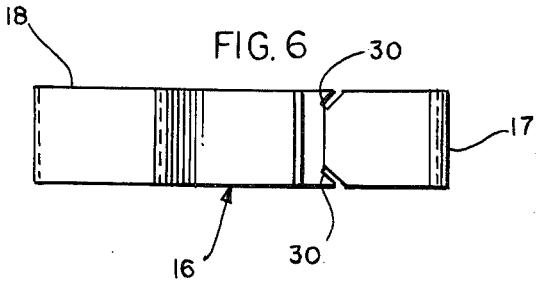
FIG. 6 is a bottom view of a resilient restraining member.

In the illustration given and with reference first to FIG. 1, the numeral 10 designates generally a cabinet utilizing a cabinet drawer restrainer 11 in accordance with the present invention. The cabinet 10 has a drawer 12 and includes a rail 13 integral with the drawer 12, a run 14 secured to the cabinet 10 and a transport means either in the form of a roller 15 or a glide (not shown) secured to the drawer 12. The cabinet drawer restrainer 11 includes a resilient restraining member 16 having a first spring portion 17 which can be a clip at one end adapted to be attached to the run 14 and a second spring portion 18 which can be a detent at the other end adapted to normally extend into the run.

The roller 15 is disposed to travel along the run 14 and to urge the spring detent portion 18 out of its path of travel as the drawer 12 is moved toward a closed position. The spring detent portion 18 thereafter returns to its normal position extending into the run 14 to cooperate with the roller 15 to releasably retain the drawer 12 in the closed position. The roller 15 again is disposed to travel along the run 14 and to urge the spring detent portion 18 out of its path of travel as the drawer 12 is later moved toward an open position. With these features of construction, the resilient restraining member 16 prevents unintentional movement of the drawer 12 from the closed position to the open position that might otherwise be caused by movement of the cabinet 19 or its environment.

The run 14 is a generally C-shaped channel having spaced top and bottom members 19 and 20, respectively, joined by a side member 21. The top member 19 is interrupted along its length to define a clip receiving tab 22 and a detent receiving opening 23 with the bottom member 20 having a reverse indent 24 extending into the run 14 in the path of travel of the roller 15. The reverse indent 24 in the bottom member 20 is generally V-shaped extending upwardly in alignment with the detent receiving opening 23 in the top member 19. The resilient restraining member 16 is located at a position near the end 25 of the run 14 adjacent the rear of the cabinet 10. The spring detent portion 18 is also generally V-shaped normally extending through the detent receiving opening 23 into the run although it also could conceivably be a downwardly extending leaf spring. The spring clip portion 17 has at least one and preferably two barbs 30 to bitingly engage the clip receiving tab 22 to retain the resilient restraining member 16 in position. The run 14 also includes a stop 26 in the form of a projection extending into the run 14 in the path of travel of a pin 29 attached to the drawer 12. The stop 26 is located near the end 27 of the run 14 adjacent the front of the cabinet 10 to limit movement of the drawer 12 between the closed position and the open position.

In the preferred embodiment, the run 14 also includes a roller 28 to cooperate with the rail 13 for movement of the drawer 12 between the closed position and the open position. The roller 28 is secured to the run 14 at a position near the end 27 of the run 14 adjacent the front of the cabinet 10. With these features of construction, the drawer 12 easily can be moved in conventional fashion between a fully closed position and a fully open position.

Figure 7:
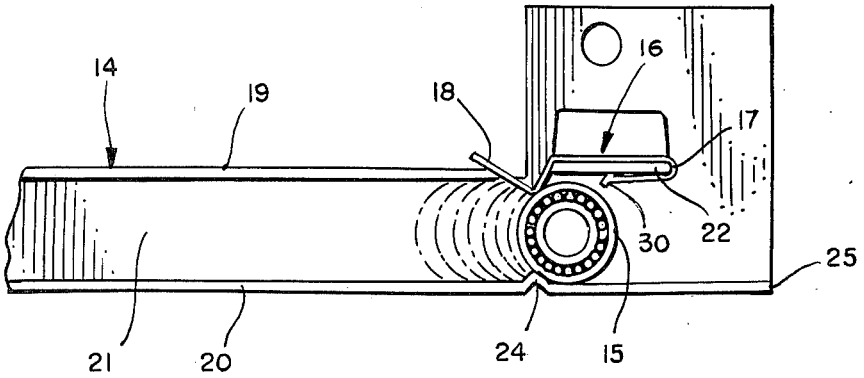
FIG. 7 is a side elevational view illustrating the cooperative relationship between the resilient restraining member, run, reverse indent, and roller.

Referring to FIGS. 1 and 7, the operation of the cabinet drawer restrainer 11 can be understood. The drawer 12 is in a fully closed position when the roller 15 is located near the end 25 of the run 14 adjacent the rear of the cabinet 10. The roller 15 will then be positioned rearwardly of the spring detent portion 18 and the reverse indent 24 to prevent unintentional movement of the drawer 12 from the closed position to the open position. The resilient restraining member 16 can accomplish this objective without the reverse indent 24 (as shown in FIG. 4) although I have found it advantageous to provide both for reasons which will become apparent below. The drawer 12 is also limited by the stop 26 to movement between the closed position and the open position.

If it is desired to move the drawer 12 from the closed position to the open position, a pulling force is applied to the drawer 12 to cause the roller 15 to pass over the reverse indent 24 and by the resilient restraining member 16. The pulling force causes the roller 15 to roll up and down over the generally V-shaped reverse indent 24 (as shown in FIG. 7) while at the same time urging the spring detent portion 18 upwardly through the detent receiving opening 23 out of its path of travel. After the roller 15 has passed by the reverse indent 24 and the resilient restraining member 16, the pulling force required to move the drawer 12 to an open position is much less since the roller 15 rides along the bottom member 20 of the run 14 and the rail 13 of the drawer 12 rides along the roller 28.

If it is later desired to move the drawer 12 from the open position to the closed position, a pushing force is applied to the drawer 12 to cause the roller 15 to again ride along the bottom member 20 of the run 14 and the rail 13 to again ride on the roller 28. The pushing force must be increased as the roller 15 reaches the reverse indent 24 and the resilient restraining member 16 to cause the roller 15 to ride up and down over the generally V-shaped reverse indent 24 (as shown in FIG. 7) while at the same time urging the spring detent portion 18 upwardly through the detent receiving opening 23 out of its path of travel. After the roller 14 has passed by the reverse indent 24 and the resilient restraining member 16, the spring detent portion 18 returns to its normal position extending into the run 14 to cooperate with the roller 15 to releasably retain the drawer 12 in the fully closed position.

If it is still later desired to remove the drawer 12 from the cabinet 10, a pulling force is again applied to the drawer 12 to move the drawer 12 from the closed position to the open position at which point the pin 29 is in contact with the stop 26. The drawer 12 can then be lifted slightly until the pin 29 will pass over the stop 26 for complete removal. It will be appreciated, however, that the stop 26 prevents inadvertantly pulling the drawer 12 completely out of the cabinet 10 because of the cooperation of the stop 26 with the pin 29.

The resilient restraining member 16 is retained on the clip receiving tab 22 by means of the barbs 30 permitting it to be an add-on item to existing cabinets although it could also conceivably be welded or otherwise made integral with the clip receiving tab 22. The run 14, however, including the top member 19, bottom member 20, side member 21, clip receiving tab 22, reverse indent 24, and stop 29 can all suitably be integrally formed from a single piece of material to reduce manufacturing and assembly costs. With the barbs 30, I have found that the resilient restraining member 16 can be firmly held in position on the run 14 over a long period of time through both opening and closing operations provided only that it is constructed of a sufficiently heavy gauge of spring material such as on the order of 0.020 " to resist any buckling tendency.

With reference to the embodiment illustrated in FIG. 4, the reverse indent 24 has been omitted. The opening and closing operations hereinabove described are essentially the same with or without the reverse indent although the up and down movement of the roller 15 does not occur without the reverse indent at the point where the roller 15 contacts the spring detent portion 18 of the resilient restraining member 16. The reverse indent is believed to be desirable, however, for at least two reasons; namely, it serves as a slight obstruction for the roller 15 to help maintain the drawer 12 in the closed position, and it essentially precludes any buckling tendency in the resilient restraining member 16 since the roller 15 lifts slightly just at the time that upward movement of the spring detent portion 18 is required to permit the roller 15 to pass. In other words, with the reverse indent 24 present, the spring detent portion 18 is flexed upwardly by upward movement of the roller 15 as well as by horizontal travel of that roller. With the coaction of the reverse indent 24 and the resilient restraining member 16, I have been able to provide a greatly improved cabinet drawer restrainer 11 in which one of the components can be constructed as an add-on for pre-existing cabinets.

While in the foregoing specification a detailed description of the invention has been set forth for purposes of illustration, variations of the details herein given may be made by those skilled in the art without departing from the spirit and scope of the invention.

I claim:

1. In a cabinet having a drawer, and including a rail provided by said drawer, a run secured to said cabinet and a roller secured to said drawer, said run being generally in the form of a C-shaped channel having spaced top and bottom members joined by a side member, said top member being interrupted along its length to define a detent-receiving opening, the improvement comprising a resilient restraining member having a spring clip portion joined to said run and a spring detent portion normally extending into said run, said roller being disposed to travel along said run and to urge said spring detent portion out of its path of travel as said drawer is moved toward a closed position, said spring detent portion thereafter returning to its normal position extending into said run to cooperate with said roller to releasably retain said drawer in said closed position, said roller again being disposed to travel along said run and to urge said spring detent portion out of its path of travel as said drawer is later moved toward an open position, said bottom member including a reverse indent extending into said run in the path of travel of said roller below and spring detent portion, whereby, said resilient restraining member and said reverse indent prevent unintentional movement of said drawer from said closed position to said open position that might otherwise be caused by movement of said cabinet or its environment.

2. The cabinet of claim 1 in which said spring clip portion of said resilient remaining member is provided at one end of said spring detent portion of said resilient restraining member is provided at the other end.

3. The cabinet of claim 1 in which said reverse indent is generally V-shaped extending upwardly in alignment with said detent-receiving opening into said run.

4. The cabinet of claim 1 in which said resilient restraining member is located at a position near the end of said run adjacent the rear of said cabinet.

5. In a cabinet having a drawer, and including a rail provided by said drawer, a run secured to said cabinet and a roller secured to said drawer, said run comprising a generally C-shaped channel having spaced top and bottom members joined by a slide member, said top member being interrupted along its length to define a detemt-receiving opening, the improvement comprising a resilient restraining member having a spring clip portion joined to said run and a spring detent portion of generally V-shaped configuration normally extending through said detent-receiving opening into said run, said roller being disposed to travel along said run and to urge said spring detent portion out of its path of travel as said drawer is moved toward a closed position, said spring detent portion thereafter returning to its normal position extending into said run to cooperate with said roller to releasably retain said drawer in said closed position, said roller again being disposed to travel along said run and to urge said spring detent portion out of its path of travel as said drawer is later moved toward an open position, whereby, said resilient restraining member prevents unintentional movement of said drawer from said closed position to said open position that might otherwise be caused by movement of said cabinet or its environment.

6. The cabinet of claim 5 in which said top member includes a clip-engaging tab adjacent said detent-receiving opening, said spring clip portion including a barb to bitingly engage said clip-receiving tab to retain said resilient restraining member in position.

7. In a cabinet having a drawer, and including a rail provided by said drawer, a C-shaped run having spaced horizontal top and bottom members defining a channel therebetween, and a rider secured to said drawer and received in said channel for guiding said drawer between open and closed positions, the improvement comprising said top member being interrupted along its length to provide a detent-receiving opening, a restraining member secured to said run and including a movable spring detent normally disposed in said channel, said spring detent being movable upwardly away from said channel upon forceful engagement by said rider when said drawer is moved toward a closed position and thereafter returning to its normal position extending into said channel to retain said drawer in its closed position, said detent also being movable upwardly away from said channel upon forceful engagement by said rider to permit movement of said drawer out of said closed position and into said open position, said bottom member having a reverse indent projecting into said channel below said spring detent to direct said rider upwardly as said rider engages said dentent, therey promoting upward movement of said detent upon engagement by said rider and assisting in retaining said drawer when the same is in its closed position.

8. The cabinet of claim 7 in which said indent is generally of inverted V-shaped configuration and provides sloping surfaces for engagement with said rider.

9. The cabinet of claim 7 in which said spring detent is of generally V-shaped configuration and provides sloping surfaces for engaement with said rider.

10. The cabinet of claim 7 in which said restraining member includes a spring clip attachment portion frictionally and securely engaging said upper member of said run.

11. The cabinet of claim 10 in which said spring detent means and said spring clip portion are integrally formed and are disposed at opposite ends of said restraining member.

12. The cabinet of claim 10 in which said spring clip portion includes a barb to bitingly engage said upper member for securing said resilient restraining member in position.

13. The cabinet of any one of claims 7 through 28 in which said rider is a roller.

* * * * *